United States Patent [19]

Rothwell, Jr. et al.

[11] 4,415,829

[45] Nov. 15, 1983

[54] DIRECT CURRENT OPERABLE ARC LAMP

[75] Inventors: Harold L. Rothwell, Jr., Rowley; George J. English, Reading; William M. Keeffe, Rockport, all of Mass.

[73] Assignee: GTE Products Corporation, Stamford, Conn.

[21] Appl. No.: 292,373

[22] Filed: Aug. 13, 1981

[51] Int. Cl.[3] ..... H01J 61/06

[52] U.S. Cl. ..... 313/621; 313/623; 313/632; 313/633

[58] Field of Search ..... 313/217, 218, 208, 343, 313/211, 213

[56] References Cited

U.S. PATENT DOCUMENTS 4,320,322 3/1982 Rothwell, Jr. et al. ..... 313/220 X

*Primary Examiner*—Palmer C. Demeo

*Assistant Examiner*—Sandra L. O'Shea

*Attorney, Agent, or Firm*—William H. McNeill

[57] ABSTRACT

A D.C. operable, miniature, low-wattage, single ended, arc discharge lamp. The cathode electrode includes electrical field modifying means to insure that the arc strikes between the electrode tips. During high pressure (~10 atm) operation electrode heating of the anode is dominated by electron bombardment, which creates substantially higher heat at the anode tip than at the cathode tip (the cathode being heated by ion bombardment and cooled by thermionic electron emission). Heat conducted down the anode electrode is dissipated in the single press and contributes to the heat conduction in the closely adjacent cathode electrode thereby reducing the net heat loss therein and helping to maintain the desired cathode temperature.

5 Claims, 1 Drawing Figure

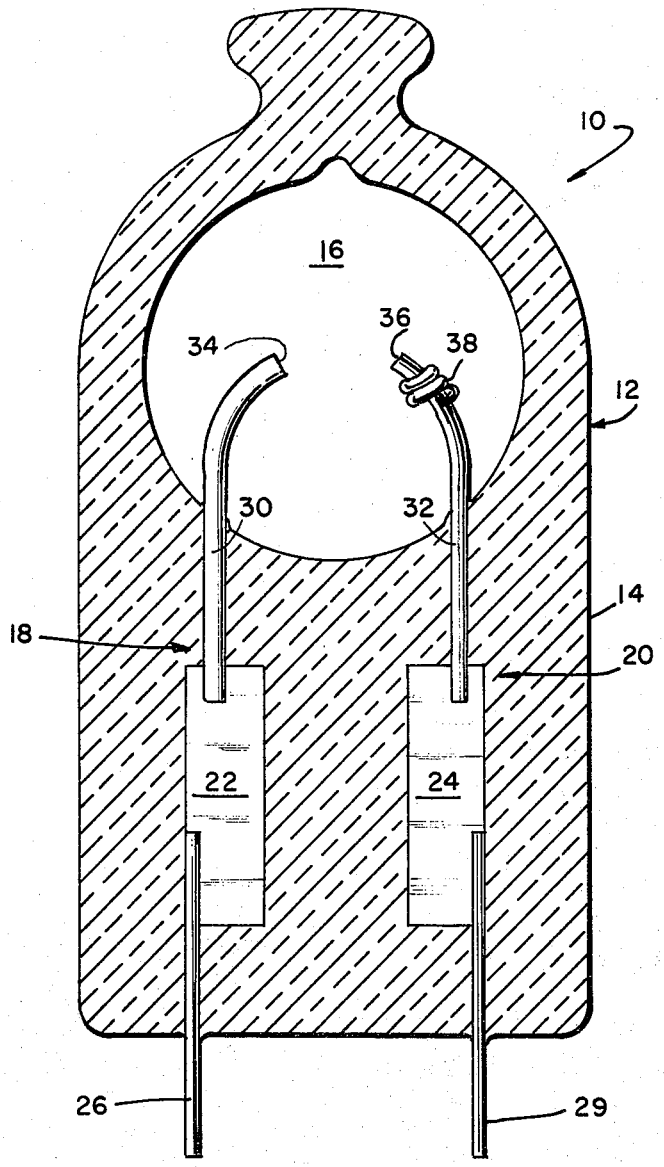
10
16
36
38
34
12
30
32
14
18
20
22
24
26
29

DIRECT CURRENT OPERABLE ARC LAMP

TECHNICAL FIELD

This invention relates to arc discharge lamps and particularly to such lamps which are operable from direct current (D.C.) ballast supplies. Still more particularly, the invention is concerned with miniature, low wattage, single ended lamps of this type. A single ended lamp is a lamp having electrodes deployed in one end only.

BACKGROUND ART

D.C. operable, short arc disharge lamps are generally constructed as double ended units having the electrodes diametrically opposed to one another. These lamps are relatively fragile and cumbersome to employ and usually are designed for operation in only one orientation.

DISCLOSURE OF INVENTION

It is, therefore, an object of this invention to obviate the disadvantages of the prior art.

It is another object of the invention to enhance D.C. operable arc discharge lamps.

These objects are accomplished, in one aspect of the invention, by the provision of a single ended, arc discharge lamp having a glass body with a press seal formed at one end opposite an arc chamber. An anode electrode and a cathode electrode have intermediate portions sealed in the press seal and first ends projecting exteriorly of the body and second ends terminating within the arc chamber. The electrodes are substantially parallel to one another for a major portion of their length but have their terminal ends inclined toward each other to define an arc gap. The cathode electrode only is provided with an electrical field modifying means positioned substantially adjacent its terminal end.

This construction allows the use of electrodes substantially similar in size (in prior art double ended D.C. lamps the anode is typically greater than 400% as massive as the cathode) since heat conducted down the anode is dissipated in the press region which contributes to heat conduction in the cathode and helps to maintain cathode temperature.

The use of the electrical field modifying means adjacent the cathode tip insures that the initial arc strikes between the electrode tips. Absent such modifying means there is a tendency for the initial arc to appear between the tips of the anode and the base of the cathode at its junction with the press seal.

BRIEF DESCRIPTION OF THE DRAWING

The single FIGURE is a sectional, elevational view of a lamp embodying the invention.

BEST MODE FOR CARRYING OUT THE INVENTION

For a better understanding of the present invention, together with other and further objects, advantages and capabilities thereof, reference is made to the following disclosure and appended claims taken in conjunction with the above-described drawing.

Referring now to the drawing with greater particularity, lamp 10 has a body 12 of, for example, fused silica. The body 12 can be fabricated from fused silica tubing having an 8 mm I.D. with a 1 mm wall thickness. A press seal 14 is formed at one end opposite an arc chamber 16 which has a volume of about 0.35 $cm^3$. An anode electrode 18 and a cathode electrode 20 are sealed in the press seal by intermediate portions 22 and 24 respectively, which can be thin (0.0013″) molybdenum foils.

As noted above, the use of the single ended construction permits the employment of electrodes which are substantially the same size; however, to insure proper cathode tip temperature, which should be approximately 2400°K to enhance thermionic emission and avoid cathode meltback, it is preferred that the anode be from 100% to 115% of the cathode diameter. In one specific embodiment for a low wattage lamp ($\leqq$100 W) an anode diameter of 0.017″ and a cathode diameter of 0.015″ was found to be suitable.

The electrodes 18 and 20 additionally have first ends 26 and 29 which project exteriorly of seal 14 and second ends 30 and 32 which extend into and terminate within arc chamber 16. At least these second ends are substantially parallel to one another for a major portion of their length. The terminal ends, 34 and 36, are inclined toward each other and define therebetween an arc gap. At least the second ends 30 and 32 are preferably formed from tungsten wire containing 1% thorium oxide.

The cathode electrode 20 is provided with electrical field modifying means 38 positioned adjacent its terminal end 36. Preferably, means 38 is a coiled-coil of tungsten, about 2 ½ turns being suitable.

The means 38 is necessary to insure that the arc strikes between the electrode tips. In the absence of the means 38 there is observed a strong tendency for the D.C. arc to strike between the anode tip 34 and the base of the cathode where it joins the press. It is believed that this condition is caused by a "hollow cathode effect" during ignition and early plasma growth since the arc has never been observed to terminate in the press region around the anode.

The chemical fill for the lamp includes mercury, the iodides of sodium and scandium with a backfill of argon.

While there have been shown and described what are at present considered to be the preferred embodiments of the invention, it will be apparent to those skilled in the art that various changes and modifications can be made herein without departing from the scope of the invention as defined by the appended claims.

We claim:

1. A miniature, single-ended, low-wattage D.C. operable, arc discharge lamp comprising: a glass body having one end formed as a press seal and another end formed to provide an arc chamber; an anode electrode and a cathode electrode each having intermediate portions sealed in said press seal, said electrodes having first ends extending exteriorly of said body and second ends extending into and terminating within said arc chamber, said electrodes being substantially parallel to one another for a major portion of their length and having their terminal ends inclined toward each other to define therebetween an arc gap; said cathode electrode only having, substantially adjacent its terminal end, electrical field modifying means.

2. The lamp of claim 1 wherein said electrical field modifying means comprises a tungsten coil.

3. The lamp of claim 2 wherein said tungsten coil is a coiled-coil.

4. The lamp of claim 3 wherein said electrodes are formed from tungsten wire containing 1% thorium.

5. The lamp of claim 3 wherein said cathode electrode has a diameter "x" and said anode electrode has a diameter from 100% to about 115% of "x".

* * * * *